US006162324A

United States Patent [19]

Miller

[11] Patent Number: 6,162,324

[45] **Date of Patent: *Dec. 19, 2000**

[54] OXYGEN DELIGNIFICATION OF MEDIUM CONSISTENCY PULP SLURRY USING TWO ALKALI ADDITIONS

[75] Inventor: William J. Miller, Manchester, N.H.

[73] Assignee: Beloit Technologies, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,810

[22] Filed: Oct. 14, 1997

Related U.S. Application Data

[63] Continuation of application No. 08/568,779, Dec. 7, 1995, abandoned.

[51] Int. Cl.[7] ..... D21C 9/147

[52] U.S. Cl. ..... 162/57; 162/65; 162/90

[58] Field of Search ..... 162/65, 68, 57, 162/90, 19

[56] References Cited

U.S. PATENT DOCUMENTS

| | | | |
|---|---|---|---|
| 3,719,552 | 3/1973 | Farley et al. | 162/78 |
| 3,843,473 | 10/1974 | Samuelson et al. | 162/65 |
| 3,951,733 | 4/1976 | Phillips | 162/65 |
| 4,093,506 | 6/1978 | Richter | 162/57 |
| 4,363,697 | 12/1982 | Markham et al. | 162/19 |
| 4,842,690 | 6/1989 | Gazdik et al. | 162/57 |
| 5,011,572 | 4/1991 | Parthasarathy et al. | 162/65 |
| 5,034,095 | 7/1991 | Kido et al. | 162/65 |
| 5,145,557 | 9/1992 | Peter et al. | 162/65 |
| 5,296,099 | 3/1994 | Griggs et al. | 162/65 |

FOREIGN PATENT DOCUMENTS

| | | |
|---|---|---|
| 0078129 | 4/1983 | European Pat. Off. . |
| 0641833 | 8/1995 | European Pat. Off. . |

OTHER PUBLICATIONS

"The Efficient Use of Hydrogen Peroxide as a Chemical Pulp Delignification Agent", by Troughton and Sarot, TAPPI Proceedings 519–535 (1992).

"The Function of Magnesium Compounds in an Oxygen–Alkali–Carbohydrate System", by Sinkey and Thompson, Paperi ja puu, No. 5, 473–486 (1974).

"OZP–Bleaching of Kraft Pulps to Full Brightness", by U. Germgard and S. Norden, Intl. Pulp Bleaching Conf., 53–58 (1994).

"Pressurized Hydrogen Peroxide Bleaching for Improved TCF Bleaching", by Bertil Stromberg and Richard Szopinski, Intl. Pulp Bleaching Conf., 199–209 (1994).

*Primary Examiner*—Steve Alvo

*Attorney, Agent, or Firm*—Sonnenschein Nath & Rosenthal

[57] ABSTRACT

An improved process is described for oxygen delignification of medium consistency pulp slurry which teaches control parameters and their resultant effect on final product characteristics. Specifically, a process is described wherein pulp slurries of from approximately eight percent to sixteen percent consistency, are heated to a temperature of at least 170° F. and impregnated oxygen gas and alkali to bring the slurry to a pH of from approximately 11–12.5. The slurry is mixed in a high shear mixer, for agitating mixing therein, under pressure of from approximately 20–180 psig for a first reaction time of typically 5 minutes. Additional alkali is added to the slurry to return the pH to at least 11, preferably at least 12, and the residual alkali concentration to at least 4.0 gpl at the end of the first reaction time. The temperature of the slurry is raised to at least 170° F. followed by mixing for a second reaction time of typically 55 additional minutes.

4 Claims, 3 Drawing Sheets

OXYGEN DELIGNIFICATION OF MEDIUM CONSISTENCY PULP SLURRY USING TWO ALKALI ADDITIONS

This application is a continuation of application Ser. No. 08/568,779 filed on Dec. 7, 1995 now abandoned.

TECHNICAL FIELD

This invention pertains to methods and apparatii for delignification of softwood pulp in a slurry, and in particular to an improved method for oxygen delignification of medium consistency pulp slurry. This method utilizes a two phase reaction design.

BACKGROUND OF THE INVENTION

The known methods and apparatii for oxygen delignification of medium consistency pulp slurry consist of the use of high shear mixers and upflow pressurized reactors with retention times of twenty to sixty minutes. These are operated at consistencies of ten to fourteen percent (o.d.) at an alkaline pH of from 10.5 to 13. Oxygen gas is contacted with the pulp slurry in a turbulent state lasting less than one second. These have evolved to processes and apparatii using two pressurized reactors, each with high shear mixers, to mix the oxygen gas twice, to improve overall performance. To date, use of the aforesaid methods and apparatii have typically resulted in pulp kappa reductions (i.e., delignification) of forty to forty-five percent, with some two-reactor systems claiming more than forty-five percent. However, many systems perform below forty percent kappa reductions.

The disadvantages of the known methods and apparatii is that the low levels of kappa reduction make medium consistency oxygen delignification, by itself, unacceptable as a pretreatment to a Total Chlorine Free (TCF) bleach plant utilizing ozone and peroxide bleaching agents. TCF bleach plants are documented as requiring incoming kappa numbers below fifteen, and preferably below twelve. These low kappa numbers are required for reasons of quality, economics, process design, and such. Process technology required to achieve these low kappa results for softwoods, in addition to medium consistency oxygen delignification, are quinone (AQ) cooking. It has also been claimed (U.S. Pat. Nos. 5,173,153 and 5,085,734) that the high consistency oxygen delignification with the patented $O_M$ process results in reduction of sixty percent, and is the preferred oxygen delignification technology.

These aforesaid technologies require high capital expenditures or high consistency oxygen delignification processing for pulp treatment before the TCF bleach plant, and accordingly, will exclude many pulp mill operations from the ability to economically modify their processes. In most cases they also require the installation of significant amounts of equipment which have a high level of operational complexity. In addition, there is still a penalty in product yield associated with the extended cooking to attain the kappa levels necessary for TCF bleaching.

It has been understood that oxygen delignification reaction proceeds under two distinct orders of reaction kinetics. The first reaction occurs rapidly, and is responsible for lignin fragmentation (delignification). It is a radical bleaching reaction that is dependent on alkali concentration or pH to proceed. It also consumes alkali as it proceeds and generates organic acids, causing pH to drop by one to two points during the reaction time. This is consistent with the field observations of operating systems. The second reaction occurs slowly, at a rate estimated to be twenty times slower than the first reaction. This reaction is responsible for the destruction of chromophoric structures (brightness development). It is an ionic bleaching reaction that is dependent on alkali concentration, or pH, to proceed. It also will consume alkali as it proceeds and generate organic acids, causing the pH to drop by one to two points during the reaction time.

SUMMARY OF THE INVENTION

It is a purpose of this invention to set forth a method for delignifying softwood pulp in a slurry at medium consistency to a level of approximately forty-five to sixty percent. The invention can be utilized for retrofits to existing medium consistency oxygen delignification systems as well as for new systems. This will allow many pulping operations to operate in a kappa reduction range acceptable of TCF processes with a relatively low capital expenditure. They will also be utilizing a process that is both familiar and proven to the industry, as well as one simple to operate. It is a purpose to set forth a method and apparatus which can be used in an interim step to a full scale delignification system and, thus, allow pulp mills means for meeting short term environmental goals while planning for the future requirements.

Particularly, it is a purpose of this disclosure to define a method of oxygen delignification of medium consistency pulp slurry, comprising the steps of: (1) providing a pulp slurry of from approximately ten percent to sixteen percent consistency; (2) adding alkali to bring the slurry to a pH of at least 11, more preferably 12; (3) introducing the slurry to oxygen gas in a high shear mixer, for agitating mixing therein, under a pressure of from approximately 20–180 psig; (4) reacting for a first reaction temperature of from approximately 170–240° F., more preferably 190 to 220° F. and a first reaction time of from 3–10 minutes, more preferably 4–8 minutes, still more preferred 4–6 minutes, and most preferred, approximately 5 minutes; (5) adjusting the pH of the slurry to at least 11, preferably at least 12, while also making sure that the residual alkali in the system is at least 4.0 gpl and optionally adding additional oxygen gas; (6) raising the temperature to approximately 170–240° F., more preferably 190 to 220° F.; and agitating mixing the slurry in a mixer and retaining for a final reaction time for 30–180 minutes, more preferably 40–120 minutes, still more preferred 50–70 minutes, most preferred approximately 60 minutes.

As used in this application, kappa numbers are a measure of the amount of oxidizable material remaining in the pulp while ISO numbers are a measure of the brightness of the material (which is also a measure of the amount of lignin still present, which imparts a brownish color to the product). The brightening reaction occurs primarily in the second phase of the reaction. It is highly desirable to minimize the kappa number while maximizing the ISO number of the product.

The aforesaid, and further purposes and features of the invention will become apparent by reference to the following description, taken in conjunction with the accompanying figures.

DESCRIPTION OF THE PREFERRED EMBODIMENTS

A particular novelty of the invention obtains in its address to the aforenoted two, specific reaction/kinetics phases associated with oxygen delignification. The first reaction has been assumed, in known systems, to take place in ten to twenty minutes, and its alkali consumption effect has been underestimated. Actually, this first reaction takes place in one to five minutes when the slurry is agitated. Agitation is important for the first reaction to proceed efficiently. This promotes the disturbance of the pulp/water boundary layer, allowing for more efficient mass transfer of oxygen to the lignin. This is consistent with observations which have been made on pilot and commercial operations. It will reduce the kappa number by twenty to thirty percent and will drop the pH by one half to one point. After this initial reaction has spent itself, it is important to immediately replenish the consumed alkali and/or oxygen to allow the kinetics of the second ionic reaction to proceed efficiently and complete delignification to forty-five to sixty percent kappa reduction. Agitation is equally important for the second ionic reaction to proceed, but does not need the intensity of the first reaction.

As stated earlier, pH or alkali concentration, in the presence of oxygen, is crucial to the kinetics of both reactions. Due to the efficiency of the first reaction, the residual alkali concentration may not be sufficient to maintain the kinetics of the second reaction, and the kappa results of the second reaction will be minimal and the subsequent retention wasted.

Figure 5:
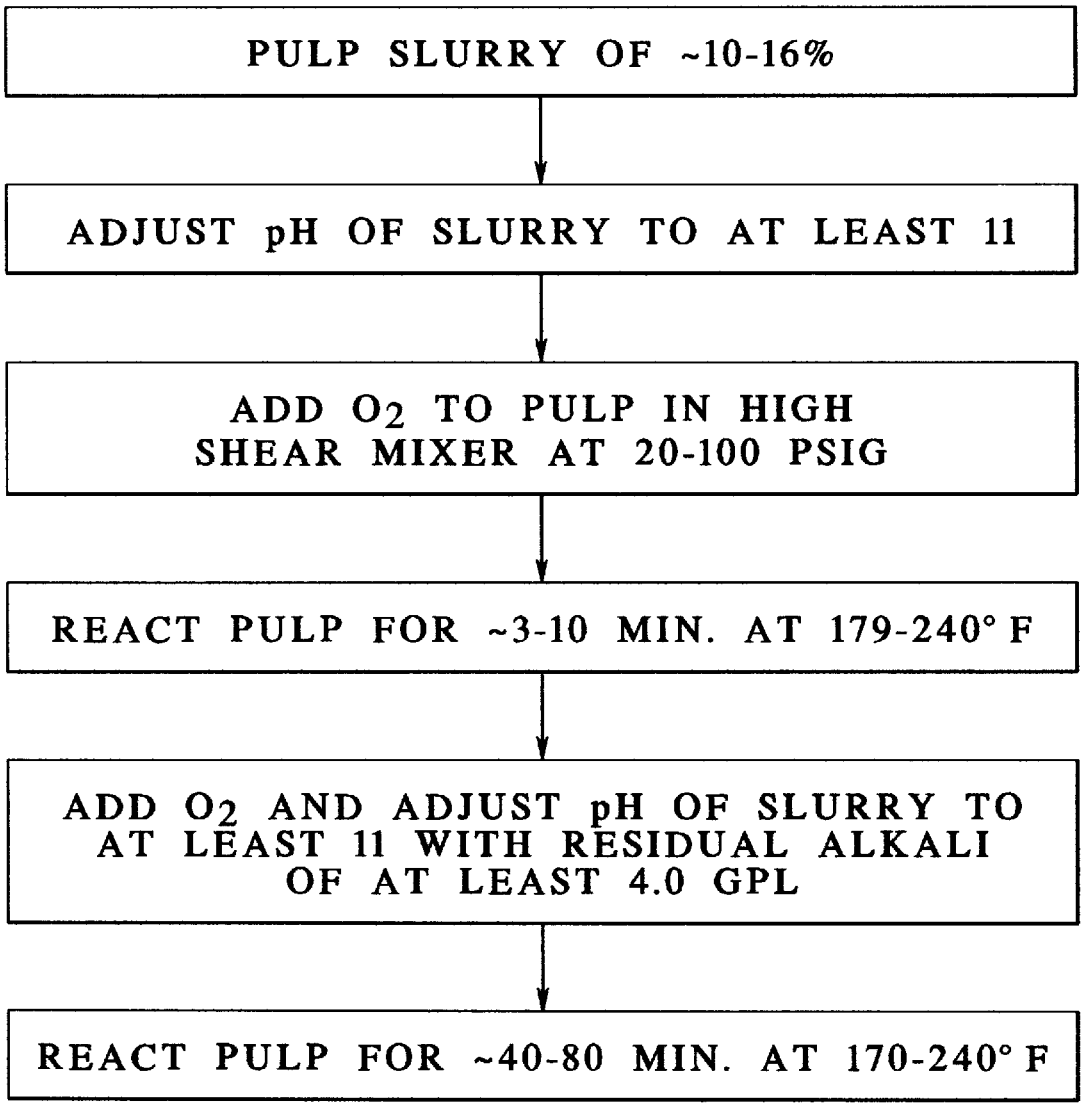
FIG. 5 is a flow diagram showing the steps in the novel method of the invention, according to an embodiment thereof

As shown in FIG. 5, the method, in its basic steps, calls for the pumping of a pulp slurry of from approximately ten percent to sixteen percent consistency, at a temperature of from 170–240° F., more preferably from 190 to 220° F. This slurry must be thoroughly impregnated with such alkali as will bring the slurry to a pH of at least 11, preferably at least 12. Then, the slurry is introduced into a high shear gas mixer for intense agitation and mixing with oxygen therein under a pressure of from approximately 20–180 psig and retaining the pulp for between 3 to 10 minutes, preferably 4 to 8 minutes, and more preferably 5 to 6 minutes reaction time. In the next step, the slurry pH is raised to at least 11, more preferably 12, by addition of alkali (NaOH) with concomitant measurement of the residual alkali level which preferably is at least 4.0 gpl, and fed to the contact mixer. The slurry must be contacted with oxygen gas, and the mixing of the slurry with the oxygen gas in the mixer occurs for a residence time which ranges from less than one second to about 5 minutes. The reaction is then allowed to continue for at least 40 to 80 minutes, preferably 50 to 70 minutes, more preferably 55 to 65 minutes.

For full delignification, two alkali addition points are needed to optimize the selectivity of the reactions. It is also critical for the residual alkali concentration be maintained initially above 4.0 gpl for the second reaction to proceed efficiently. Since the radical reaction is also where the largest viscosity drop can occur, it is important not to push this reaction too far. Excess alkali added to this reaction, with the intention of maintaining a residual pH adequate for the second reaction, will have serious effects on the selectivity of the first reaction.

Figure 3:
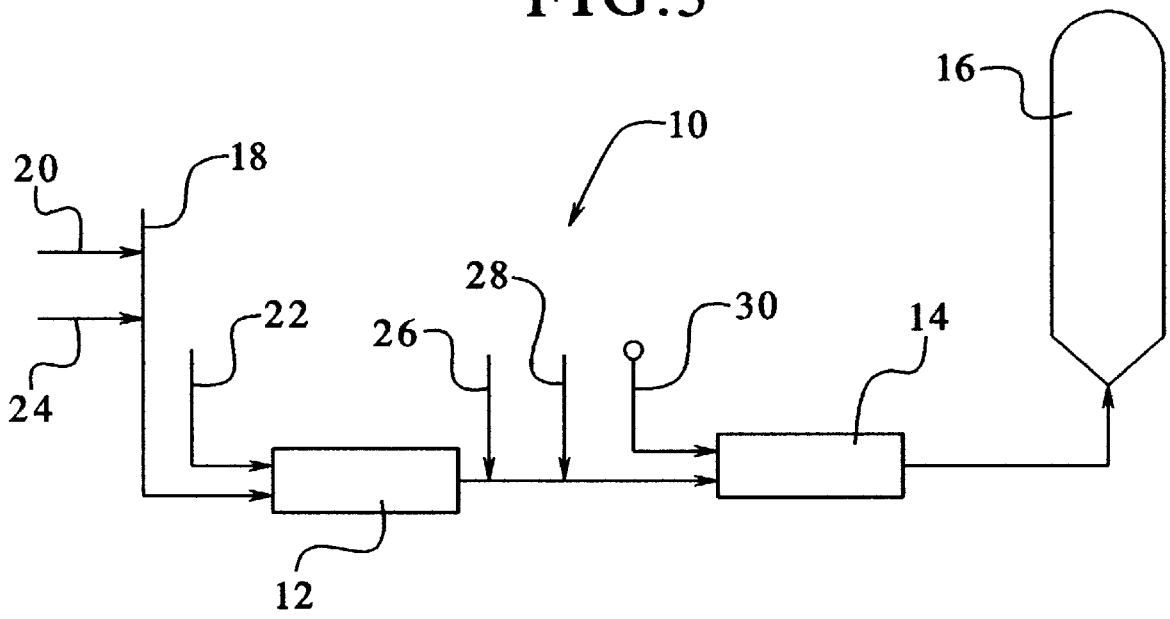
FIG. 3 is a block diagram of an embodiment of the novel apparatus, according to an embodiment thereof.

The novel method can be practiced by the apparatus 10 depicted in FIG. 3. As shown, the apparatus 10 comprises two mixers, a high shear mixer 12 and a contact gas mixer 14, installed in series with 3–5 minutes pulp retention between the two mixers. In accord with the preferred method, each mixer has a retention time of from less than one second to several minutes (e.g., 5 min.). The operating pressure of the apparatus 10, and the method which it practices, is from approximately 20–180 psig. A source 18 of pulp slurry is fed to the high shear mixer 12; it has consistency of from approximately ten to sixteen percent, and a temperature of from approximately 170–240° F., more preferably from 190–210° F. A source 20 of alkali is communicated with the mixer 12 for through mixing thereof with the slurry to effect a pH of the slurry to at least 11, more preferably at least 12. A source 22 of oxygen gas is provided to and communicated with the mixer 12, for contact thereof with the slurry in the mixer 12. The contents of the first mixer 12 are kept agitated for from less than one second to five minutes. The rapid delignification in mixer 12 reduces the kappa number of the pulp by from twenty to thirty percent, and lowers the pH by approximately one to two points. A source 24 of steam, in communication with mixer 12, insures that the slurry is at the aforesaid temperature range.

Another source 26 of alkali (although the aforesaid same source 20 could be employed) is provided and communicated with the discharged product of mixer 12, to replenish the alkali consumed, and to bring the slurry pH back to at least 11, more preferably at least 12, with a residual alkali concentration of 4.0 gpl. Another source of steam 28 (although the aforesaid same source 24 could be employed) is provided and communicated with the product to bring the slurry temperature to approximately 170–240° F., more preferably from 190–220° F. Again, oxygen gas from a source 30 (or source 22) is provided to the contact mixer 14, to replenish that which was consumed thus far. The slurry is then agitated, in the mixer 14, for from less than one second to five minutes. Finally, the product is conducted to the reactor 16. Herein the slower, ionic oxygen bleaching reaction takes place for from between 40 to 80 minutes, preferably from 50 to 70 minutes, most preferably from 55 to 65 minutes total reactor time, completing the kappa reduction number 45–60%.

Figure 4:
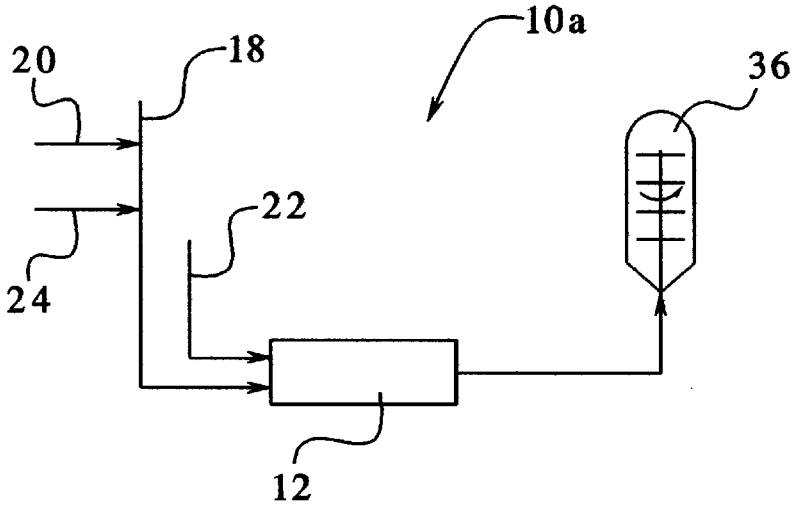
FIG. 4 is a block diagram of the novel apparatus which, as noted in the foregoing, can be used as an interim step to a full scale delignification system.

The novel method and apparatus, employing a high shear mixer, can be used to enhance the performance of an existing, medium consistency oxygen system. As noted earlier, a high shear mixer 12 can be utilized alone, with the slurry source 18, alkali source 20, oxygen source 22 and steam source 24, as an interim step to full delignification. Such an apparatus 10*a* is shown in FIG. 4. It comprises a pressurized, agitated vessel 36 which will have a retention period of from 20 seconds to 80 minutes. Vessel 36 provides for smoother pressure control, and added retention time.

The primary purpose of the 5 min./55 min. two-phase system is to provide operator control which allows succinct process changes to be made in order to improve the overall control of the two-phase oxygen delignification reaction. To accomplish this end, the oxygen delignification reaction kinetics must be understood and applied. The value of this initial measurement (typically at approximately 5 minutes), is to be capable of evaluating the progress of the delignification reaction quickly, thereby adjusting process parameters after 5 minutes reaction time rather than 20–60 minutes. It is also beneficial to predict the level of delignification for the subsequent reaction phase, which is dependent upon both the system pH and the residual alkali concentration.

Prior claims on two stage oxygen delignification allude to the two stage addition of oxygen and alkali, but state that the main beneficial claim to be due to the prevention of channelling in the reactor. Channeling as known in the art, reduces the retention time of the pulp in the reactor, which lowers delignification results. Prior art work by Kido et al. teaches a minimum pulp slurry velocity of 0.4 m/min. needs to be maintained in the first reactor to prevent channeling in the reactor. The reference example used cites a pulp slurry at 10% oven dry consistency into the reactor.

Experience with the operation of medium consistency oxygen delignification reactors has clearly demonstrated that if pulp consistency into the reactor is maintained above 10% oven dry consistency, pulp channeling in the reactor does not occur. This has been verified by tower traces on numerous occasions at reactor pulp velocities in the 0.1–0.2 m/sec range. These tower traces were performed using temperature, pH, and lithium chloride as methods of measurement, at oven dry consistencies of 10% or higher.

The improvement of this invention, therefore, does not occur from the prevention of channeling, as this is not an issue at oven dry pulp consistencies in this range, and reactor velocities below 0.4 m/min, but rather comes from the recognition of the reaction kinetics and the differing response regimes which are present in the system.

Effect of Alkali (NaOH) Concentration

Alkali (NaOH) concentration is the primary driver in the reaction kinetics and it is critical to maintain this concentration, and pH, at minimum levels during the reaction time. For operating systems, this is typically measured only by pH.

Table 1 shows a laboratory delignification response is shown for commercially produced, northern U.S. softwood pulp. The initial kappa number of this pulp was 24.7, ISO % brightness of 25.9 and a 27.0 cps viscosity. This pulp was well washed and treated in a stirred autoclave reactor under the following conditions.

Temperature: 95° C.

Oxygen pressure: 100 psig

Initial alkali charge: 1.5% on oven dry pulp

Oven dry consistency: 12.0%

TABLE 1

Northern softwood Delignification Response

| Time (min) | NaOH charge % | NaOH conc. (gpl) | Final pH | Kappa | Brightness % ISO |
|---|---|---|---|---|---|
| 0 | 1.9% | 2.59 | | 24.7 | 25.9 |
| 5 | | 1.94 | 12.6 | 18.5 | 26.6 |
| 30 | | 1.56 | 12.4 | 14.9 | 28.4 |
| 60 | | 1.42 | 12.1 | 13.2 | 30.2 |
| 0 | 1.3% | 1.55 | | 24.7 | 25.9 |
| 5 | | 1.22 | 12.0 | 19.2 | 24.9 |
| 30 | | 0.96 | 11.7 | 16.4 | 26.7 |
| 60 | | 0.74 | 11.4 | 15.2 | 27.6 |
| 0 | 1.3% | 1.5 | | 24.7 | 25.9 |
| 5 | 0.6% | 2.30 | 12.0 | 19.2 | 26.7 |
| 60 | | 1.32 | 11.9 | 13.3 | 30.3 |

Figure 1:
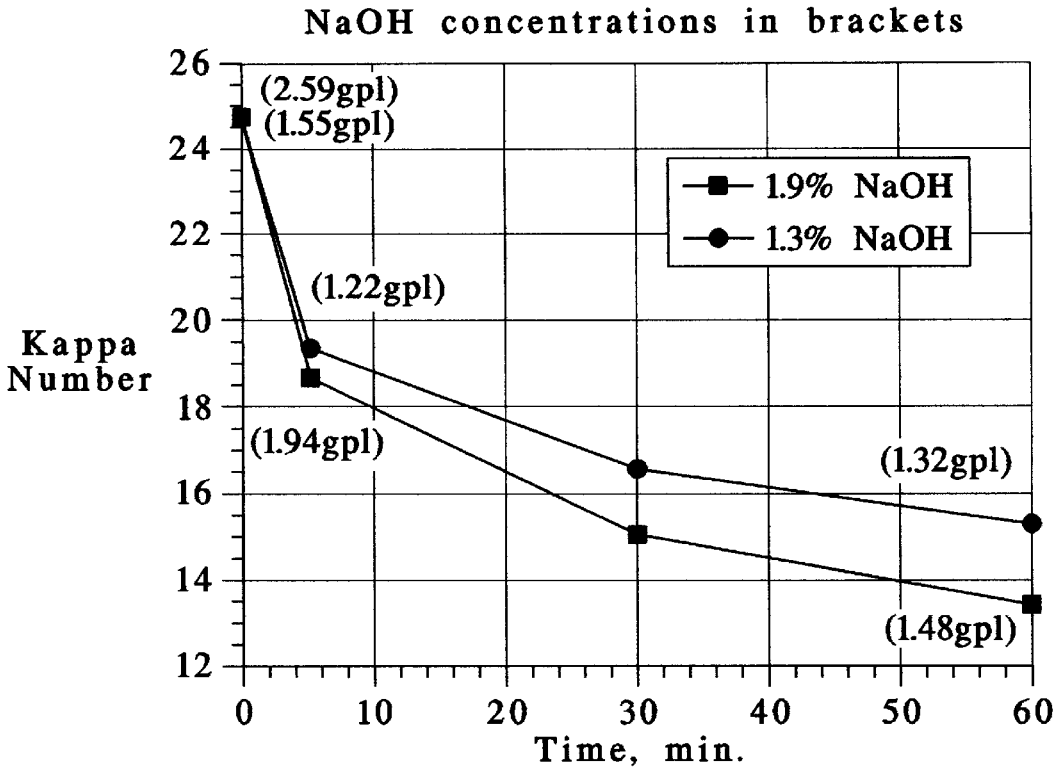
FIG. 1 is a graphical representation of the effect of alkali addition concentration vs. time.
Figure 2:
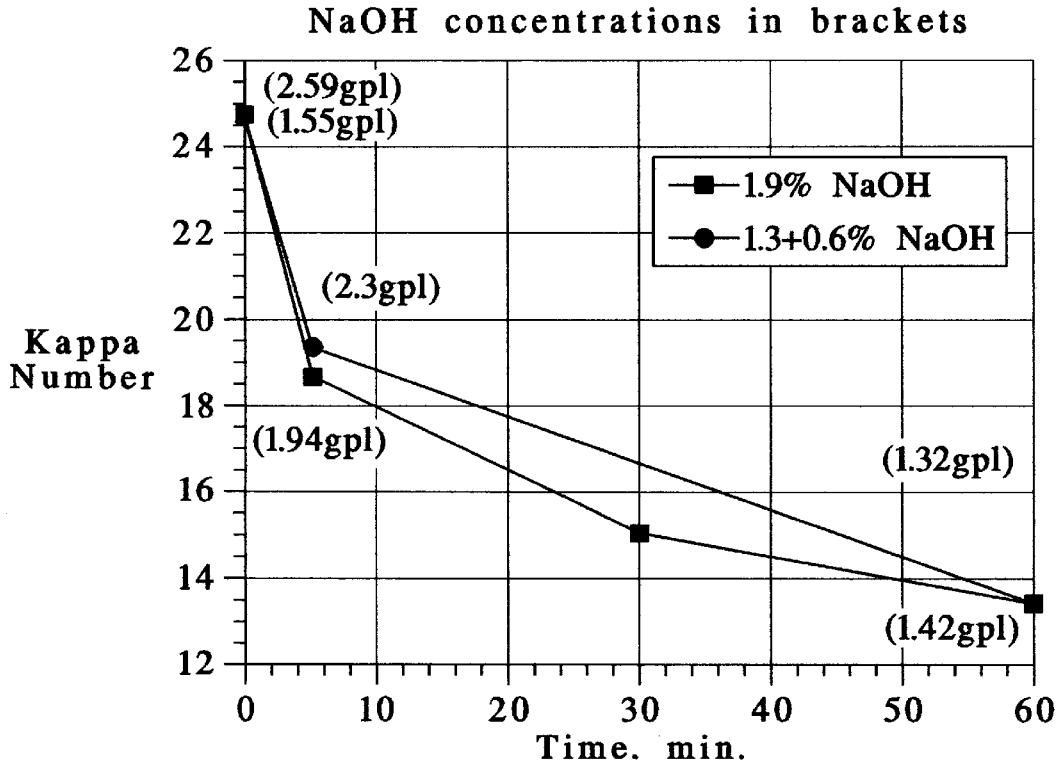
FIG. 2 is a graphical representation of the effect of double addition of alkali vs. a single addition over time.

The results from Table 1 are presented graphically in FIGS. 1 and 2. FIG. 1 shows the delignification response for two NaOH charges 1.9% ad 1.3% whereas FIG. 2 shows the split addition of base (1.3% followed by 0.6% after five minutes) in comparison to the addition of 1.9%. As expected and shown in FIG. 1, the 1.3% NaOH charge had a lower delignification response when compared to the 1.9% NaOH charge. This corresponds to lower system pH values and residual alkali during the delignification response at the 1.3% charge. The split addition set of data (1.3%, 0.6%) shows that the lower delignification at 1.3% NaOH can be corrected to that of the 1.9% NaOH charge by the addition of a second amount of base (0.6%), thereby driving the secondary reaction to a higher comparable level of overall delignification efficiency. For this well washed pulp, a minimum NaOH concentration of 2.0 gpl at a pH greater than 12.0 is required for the optimum results. This example demonstrates how monitoring an oxygen delignification system to maintain pH and NaOH residuals after five (5) minute reaction time allows for corrections to optimize the final results. Low alkali levels and/or pH (low kappa number) after 5 minutes can be detected and adjusted. Table 2 is a comparison of the final results.

TABLE 2

Comparison of Single vs. Double Addition of Base

| Sequence | Kappa number | Viscosity (cps) | Z-span (psi) | COD (kg/t) | Brightness (% ISO) |
|---|---|---|---|---|---|
| 1.9% | 13.2 | 19.6 | 23.5 | 39.5 | 30.2 |
| 1.3% + 0.6% | 13.3 | 19.8 | 24.1 | 38.3 | 30.3 |

The split NaOH addition shows a small improvement in strength measurements, for comparable delignification. A lower level of COD is generated in the final filtrates, this being highly desirable and having a positive impact on post oxygen delignification washing results.

Effect of pH (No COD Filtrate)

To test the relevance of monitoring and controlling NaOH levels and pH after 5 minutes, for process control optimization, a study was conducted to simulate field conditions as closely as possible. In this phase of the study, the pulp was well washed to simulate "perfect" conditions. Commercial operating delignification systems will have closed washing systems resulting in the introduction of carryover solids to the reactor. The impact of carryover solids is studied in the next phase and shown below.

Table 3 shows a laboratory delignification response for a commercially produced, southern U.S. softwood commercially cooked by the extended Kraft cooking process to a kappa number of 18.4 and a brightness of 25.2. This pulp was well washed and treated in a stirred autoclave reactor under the following conditions:

Temperature: 95° C.

Oxygen pressure: 100 psig

Initial alkali charge: 1.5% on oven dry pulp

Oven dry consistency: 12.0%

TABLE 3

Northern softwood Delignification Response

| Time (min) | NaOH conc. (gpl) | Final pH | Kappa | Brightness % ISO |
|---|---|---|---|---|
| 0 | 2.046 | | 18.4 | 25.2 |
| 5 | 1.82 | 12.3 | 15.9 | 27.4 |
| 60 | 1.32 | 10.8 | 9.3 | 31.2 |

This data for well-washed pulp, indicates that if a pH of 12.3 and a NaOH residual of 1.82 gpl is maintained after the initial 5 minutes of reaction, a final kappa number of 9.3 and brightness of 31.2% ISO can be attained.

Effect of COD Filtrate

To more closely simulate this for an operating system, softwood filtrate sampled from an operating final pre-oxygen washer was added to the same well-washed pulp used in Table 3. This filtrate (A) had the following characteristics:

pH: 12.6

NaOH residual: 7.3 gpl

COD: 40,475 mg/l

This filtrate was added to the pulp in equivalents of 130 kg COD/t and 200 kg COD/t under the following autoclave conditions.

| | 130 kg COD/t | 200 kg COD/t |
|---|---|---|
| Temperature: | 95° C. | 95° C. |
| Oxygen pressure: | 100 psig | 100 psig |
| Initial alkali charge: | 1.5% on oven dry pulp | 1.5% on oven dry pulp |
| Initial alkali concentration: | 532 gpl* | 6.96 gpl* |
| Oven dry consistency: | 12% | 12% |

*sum of applied alkali charge and residual alkali added with COD carryover

Traditional thinking in the field is that high levels of carryover impede the reaction, and that high COD systems do not perform well in general.

TABLE 4

Delignification Response for southern softwood at 130 kg/t and 200 kg/t COD carryover levels (Filtrate A)

| | NaOH residual (gpl) | | Final pH | | Kappa # | | Brightness (% ISO) | |
|---|---|---|---|---|---|---|---|---|
| Rxn. time | 130 kg | 200 kg | 130 kg | 200 kg | 130 kg | 200 kg | 130 kg | 200 kg |
| 0 | 5.32 | 6.96 | | | 18.4 | 18.4 | 252 | 25.2 |
| 5 | 4.24 | 5.64 | 12.4 | 12.1 | 14.2 | 14.3 | 28.0 | 27.2 |
| 60 | 2.98 | 3.88 | 10.0 | 10.0 | 10.7 | 10.2 | 32.1 | 33.0 |

The five (5) minute reaction time results shown in Table 4 are both surprising and unexpected when compared to the five minute reaction time results shown in Table 1. These 5 minute results indicate that the residual alkali in the carryover, not the COD as would be expected, has the greatest impact on pulp delignification and that residual alkali enhances and improves the initial 5 minute delignification reaction. Note that both levels of COD carryover maintained the pH above 12.0 after 5 minutes. However contrary to expectations, the system with the larger amount of initial alkali (~7 gpl) attained the lowest final kappa number (10.2) even though it had the higher COD level (200 kg/t vs. 130 kg/t)

The effect of the higher residual alkali also carries over to the secondary delignification reaction.

The COD carryover appears to have its greatest impact on the secondary delignification reaction which takes place from 5–60 minutes total reaction time. It is here that residual alkali is important to overcome the COD effect. As shown in Table 3, the final kappa numbers for the two carryover levels did rise from 9.3 attained to 10.7 and 10.2 respectively, due to higher residual alkali (4.24 and 5.64 gpl) after five minute reaction times. This proves the existence of another process variable which has heretofore not been recognized to occur in the secondary delignification reaction, i.e., interactions of the residual alkali with the COD in the filtrate causing the pH to drop more rapidly as organic acid by-products are produced. It is in this secondary reaction where the maintenance of the system pH and residual alkali concentration is most critical for optimum overall delignification results. There must be enough residual alkali available to buffer the pH and maintain the delignification reaction. This was not a concern in Table 3 where no COD filtrate was used.

The characteristics of the carryover, COD and residual alkali, to the oxygen delignification reactor, will have the strongest impact on these control criteria. This is especially true after the initial 5 minute reaction time is completed.

Effect of COD and Residual Alkali

To further test the effect of carryover on this control point and final results, a second softwood filtrate sample was collected from an operating final pre-oxygen washer to be added to the same pulp sample under identical process conditions described previously.

This filtrate (B) had the following characteristics:

pH: 12.5

NaOH residual: 6.4 gpl

COD: 40,000 mg/l

This second filtrate sample differs from the previous sample used in that it has a lower residual alkali content (6.4 gpl vs. 7.3 gpl) and a comparable COD content. This filtrate was added to the pulp in equivalents of 130 kg COD/t and 200 kg COD/t under the following autoclave conditions for which Table 3 is the delignification results.

| | 130 kg COD/t | 200 kg COD/t |
|---|---|---|
| Temperature: | 95° C. | 95° C. |
| Oxygen pressure: | 100 psig | 100 psig |
| Initial alkali charge: | 1.5% on oven dry pulp | 1.5% on oven dry pulp |
| Initial alkali concentration: | 4.91 gpl* | 6.41 gpl* |
| Oven dry consistency: | 12% | 12% |

*sum of applied alkali charge and residual alkali added with COD carryover

TABLE 5

Delignification Response for southern softwood at 130 kg/t and 200 kg/t COD carryover levels (Filtrate B)

| | NaOH residual (gpl) | | Final pH | | Kappa # | | Brightness (% ISO) | |
|---|---|---|---|---|---|---|---|---|
| Rxn. time | 130 kg | 200 kg | 130 kg | 200 kg | 130 kg | 200 kg | 130 kg | 200 kg |
| 0 | 4.91 | 6.41 | | | 18.4 | 18.4 | 25.2 | 25.2 |
| 5 | 3.86 | 4.84 | 12.1 | 11.5 | 15.8 | 16.1 | 27.4 | 26.2 |
| 60 | 2.34 | 3.32 | 9.6 | 9.6 | 10.9 | 12.6 | 31.2 | 29.3 |

These results, when compared to the well-washed pulp results of Table 1, are less surprising than Table 4 results. This carryover, with less residual alkali for comparable COD, has a more detrimental effect on the delignification reaction. It is important to note, however, that the 5 minute reaction point indicates the critical process information. Unlike the results shown in Table 4, Table 5 indicates that this initial delignification reaction was not enhanced by the carryover, but the carryover was not detrimental. The initial alkali boost from the carryover was still sufficient to overcome the effect of the COD in the initial delignification reaction. However, the secondary reaction suffered significantly due to lower pH and/or lower residual alkali at the beginning of the secondary reaction.

It is concluded from Tables 4 and 5 that carryover can have a significant effect on delignification. It is not only the level of carryover, as measured by COD, but changes in residual NaOH concentration that also have an impact. The residual NaOH concentration will have the largest impact on the initial 5 minute phase results while the COD will have the largest impact on the secondary phase results. The latter statement is especially true if the residual NaOH concentration after the initial 5 minutes is too low.

Effect of Residual NaOH in Carryover

To test the delignification effects of residual NaOH in the carryover, a separate study was carried out on a commercially produced Northern softwood with a kappa number of 17.4 and a brightness of 31.3% ISO. Pre-oxygen filtrate was added to the well-washed pulp in an amount equivalent to 130 kg COD/t. Filtrate (A) was used for this study and the process conditions were identical to those described previously. The initial NaOH concentration was adjusted by neutralizing the residual NaOH in the filtrate. The results are summarized in Table 6.

TABLE 6

Effects of Pre-Oxygen Filtrate Residual NaOH on Delignification Response of a Northern Softwood (Filtrate A)

| Initial | 5 min. reaction time | | | 60 min. reaction time | | |
|---|---|---|---|---|---|---|
| NaOH gpl | resid. pl | pH | kappa | resid. gpl | pH | kappa |
| 5.05 | 3.72 | 12.3 | 13.9 | 2.82 | 9.9 | 11.1 |
| 4.69 | 3.56 | 12.2 | 14.1 | 2.38 | 9.8 | 11.2 |
| 4.43 | 3.30 | 11.3 | 14.3 | 2.20 | 9.7 | 11.4 |

Results shown in Table 6 show that as the filtrate residual NaOH decreases, the initial NaOH concentration decreases from 5.05 gpl to 4.43 gpl. This results in an increase in kappa number from 13.9 to 14.3 after the initial 5 minute reaction phase. These changes in the filtrate chemistry can be detected after 5 minutes by the lower NaOH and higher kappa numbers. The secondary delignification reaction is not affected as the NaOH residual after 5 minutes are below 4.0 gpl. Under these conditions, the COD in the system will have the greatest impact.

It is at this 5 minute reaction time where process adjustments are the most crucial. Process changes such as swings in the carryover chemistry can be detected. The primary parameters to focus on at this point are system pH and residual NaOH concentration. If either of these parameters falls below a recommended level, the secondary delignification reaction kinetics will slow down. Monitoring these parameters after 5 minutes will also be indicative of the efficiency of the primary delignification reaction.

With the 5/55 minute two phase system, these process parameters can be routinely monitored and adjusted, if needed with additional alkali. This alkali can be added at the second mixer to enhance the secondary reaction. Based on the softwood data to date, for a system with a closed washing system, the control parameters which need to be maintained after 5 minutes reaction time for 45% delignification or higher are:

Residual alkali: >4.0 gpl pH: >11.0, preferably above 12.0.

Both of these parameters must be accurately monitored and maintained.

Therefore, what has been shown is the desirability of monitoring and controlling both the residual alkali and pH at critical processing points of the reaction. The first processing point occurs at about 5 minutes into the delignification reaction of medium consistency pulp slurry. While all of the experimental data is derived for this 5 minute time frame, there is no need to limit it as such as it will vary depending upon the temperature of the reaction. Both longer and shorter first reaction times are envisioned. In general, this first reaction time will be about 3 to 10 minutes, more preferably about 4 to 8 minutes, most preferably, about 5 to 6 minutes. The second reaction time will in general, be from 40 to 80 minutes, more preferably 50 to 70 minutes, and most preferably 55 to 65 minutes.

While I have described my invention in connection with specific embodiment thereof, and specific steps of performance, it is to be clearly understood that this is done only by way of example, and not as a limitation to the scope of the invention, as set forth in the purposes thereof and in the appended claims.

I claim:

1. A method of oxygen delignification of medium consistency pulp slurry, comprising the steps of:

providing a cooked pulp in the form of a pulp slurry of from approximately ten percent to sixteen percent consistency and having a cooked pulp kappa number between 18 and 30 for softwood pulp and between 10 and 20 for hardwood pulp;

adjusting the pH of the slurry to at least 11;

adding a gas to the slurry, the gas consisting essentially of oxygen, with agitating in a high shear mixer for a first reaction with the pulp for a first reaction time ranging from 4 to 6 minutes, at a first reaction temperature of from approximately 170–240° F., the first reaction resulting in the pulp having a first reaction kappa number reduction ranging from about 20% to about 30% of the cooked pulp kappa number;

adjusting a plurality of control parameters to prepare the pulp slurry for a second reaction, the control parameters consisting essentially of the pH and the residual alkali concentration of the slurry having a chemical oxygen demand, wherein the pH is adjusted to at least 11 and the residual alkali concentration is adjusted to at least 4.0 gpl;

transmitting the slurry to a reactor;

reacting the slurry in the reactor for a second reaction time, said second reaction time ranging from 50–70 minutes, at a second reaction temperature of from approximately 170–240° F.; and maintaining an initial level of the control parameters during the second reaction resulting in the pulp of the slurry having a second reaction kappa number reduction ranging from 45% to 60% of the cooked pulp kappa number, wherein the initial level includes the pH level of at least 11 and the residual alkali concentration level of at least 4.0 gpl.

2. A method, according to claim 1, wherein the first and second reaction temperatures are from 190 to 220° F.

3. A method, according to claim 1, wherein said second reacting step further comprises introducing steam to the slurry.

4. A method, according to claim 1, wherein said step of adding oxygen gas occurs in the high shear gas mixer under a pressure of from 20–180 psig.

* * * * *